US007500333B2

(12) United States Patent
Harris

(10) Patent No.: US 7,500,333 B2
(45) Date of Patent: Mar. 10, 2009

(54) JPH BUILDING

(76) Inventor: Fitz A. Harris, 8621 NW. 53 St., Lauderhill, FL (US) 33351

( * ) Notice: Subject to any disclaimer, the term of this patent is extended or adjusted under 35 U.S.C. 154(b) by 113 days.

(21) Appl. No.: 10/740,307

(22) Filed: Dec. 18, 2003

(65) Prior Publication Data

US 2004/0168374 A1 Sep. 2, 2004

Related U.S. Application Data

(63) Continuation-in-part of application No. 09/388,077, filed on Sep. 1, 1999, now abandoned.

(51) Int. Cl.
*E04B 1/32* (2006.01)

(52) U.S. Cl. ..... 52/80.1; 52/86

(58) Field of Classification Search ..... 52/80.1, 52/86

See application file for complete search history.

(56) References Cited

U.S. PATENT DOCUMENTS 2,480,642 A * 8/1949 Galloway ..... 52/86
3,872,634 A * 3/1975 Seaman ..... 52/80.1 X
4,953,329 A * 9/1990 Frantl ..... 52/80.1
5,050,354 A * 9/1991 Vendramini ..... 52/80.1

FOREIGN PATENT DOCUMENTS

GB 2072234 A * 9/1981 ..... 52/80.1
JP 06294226 A * 10/1994 ..... 52/80.1 X

* cited by examiner

*Primary Examiner*—Anthony D. Barfield

(57) ABSTRACT

In its optimal form this building possesses a streamlined aerodynamic profile in one direction and convex shaped shell type closure components in the orthogonal direction. The system's main load carrying member, the truncated ellipse structural rib provides most of the streamlined aerodynamic profile and the rest is provided by concave surfaces connected externally to the rib's extremities. Where possible, the ribs are aligned with the anticipated direction of maximum wind velocity. Gravity loads induce vertical and horizontal foundation reactions. When the truncation points with their foundations are suitably located, the horizontal forces are directed towards the center of the rib. The rib then behaves like a closed elliptical ring capable of resisting substantial in plane forces.

Under wind loading this building attracts much less wind force than a conventionally shaped building .This invention focuses on the building's ability to attract low wind forces while providing very long clear spans.

28 Claims, 16 Drawing Sheets

JPH BUILDING

This is a Continuation-In-Part of U.S. Ser. No. 09/388,077 filed on Sep. 1, 1999 now abandoned.

BACKGROUND OF THE INVENTION

This invention pertains to the field of Structural Engineering, and is based primarily on the use of the truncated ellipse structural rib (T.E.S.R.) as a long span structural framing member. The T.E.S.R. (1) as shown in FIG. 5 is a plane curved structural member carrying in plane loading and having the geometric form of the ellipse oriented in the vertical plane with the major axis (40) horizontal and above grade, and the minor axis (41) vertical. A portion of the lower part of the curve (39) is removed between two points called the truncation points. The location of the truncation points can be varied for a given rib but they are always below the major axis. A foundation (4; FIG. 11) is provided for each truncation point, to transfer to the ground the forces developed at those points. Because of the unique geometry of the ellipse, the height of this member (44) can be easily varied while the horizontal span is kept constant. The horizontal span is the length of the major axis. Alternatively the horizontal span can be varied while the height is kept constant. The geometry of this curve is governed by the equation where a is ½ the length of the major axis (40) and b is ½ the length of the minor axis (41 in FIG. 5). The T.E.S.R. (l) can be made from any structural material, but steel is generally the most practicable. Cross sections of the T.E.S.R. and the other members can be of any structural shape, including box sections, wide flange sections or solid rectangular sections. There is no real upper limit to the span of the T.E.S.R. Generally, safe utilization of the T.E.S.R. involves assembling a minimum of two ribs spaced apart and connected by beams (11; FIGS. 7 to 11 etc.) and bracing frames (12; FIGS. 7 to 10).

This type of structural long span member has not been previously used in structural engineering. Full continuity of the rib is obtained for metals by welding or splicing with plates and structural bolts or rivets, and for concrete by making continuous monolithic concrete pours. This structure developed out of the need for economically priced large airplane hangars having large clear spans and being particularly suited for areas prone to very high velocity winds, such as those that are encountered in hurricanes, cyclones and typhoons.

Most existing large hangars are large rectangular shaped buildings, or buildings with combinations of shapes that attract large wind forces. The JPH Building attracts much smaller forces from high velocity winds than do buildings of the geometrical shapes traditionally employed in building construction. This is so because latter present mainly vertical plane surfaces to the wind, while the JPH Building in its optimum form projects mainly curved surfaces, presenting little or no vertical surfaces to the wind. Even when not in its optimum form (utilizing plane vertical doors and/or plane vertical rear walls), the JPH Building still attracts less wind forces than buildings of the traditional geometric shapes, since all JPH Buildings have the aerodynamic streamlined cross sectional profile (FIGS. 1, 2, 4 & 11). Since building structures have to be engineered to resist the forces they attract, in addition to their self weight and live loadings, there developed a need for building structures attracting less wind forces and consequently utilizing less material at less expense. This led to the development of the JPH Building. Although developed for the purpose of housing airplanes, this structure can also be used for many other purposes including hurricane shelters, houses, auditoriums, sports arenas, commercial facilities and industrial facilities. When the building use can accommodate interior columns, they can be added for extra support of the T.E.S.R.

BRIEF SUMMARY OF THE INVENTION

The primary objectives of this invention are as follows:

1. To provide primarily buildings with very long clear spans and low rise, for various uses including the housing of numbers of airplanes of any size.

Examples of approximate dimensions of the larger buildings are:

330 ft. span with 90 ft. rise
400 ft. span with 100 ft. rise
600 ft. span with 140 ft. rise
800 ft. span with 180 ft. rise
1000 ft. span with 225 ft. rise
1200 ft. span with 270 ft. rise Approximate dimensions for smaller buildings can be obtained by suitably scaling down the dimensions of the larger buildings. Accurate dimensions for all buildings are calculated from the geometric equation of the ellipse.

2. To provide buildings (as described in 1 above) that will attract the minimum wind forces under very high velocity winds such as those experienced during hurricanes, cyclones and typhoons, that is, to provide aerodynamically shaped buildings satisfying the conditions in 1 above.

3. Provide buildings satisfying the requirements of 1 & 2 above, such that each building has an entrance opening (doorway/gateway) having the same dimensions as the typical cross section of the building.

The requirements of the dimensions, span to height ratios, aerodynamics and doorway size as outlined in 1, 2 & 3 above led to the profile of the ellipse with a concave curve attached externally to each extremity of the ellipse. The elliptic shape is provided by the truncated ellipse structural rib (T.E.S.R.; 1 shown in FIGS. 4 & 5). The concave curved surfaces (2 in FIGS. 4, 11 & 12 as well as in the perspective views of FIGS. 1, 2 & 3) are provided by methods including landscaping on fill, concrete slabs or other structural framing systems, or combinations thereof. Perpendicular to the planes of the ribs, horizontal connecting beams (11) and diagonal bracing members (12) connect similar suitably spaced elliptic ribs providing the third dimension (42) of this spatial structure. The door and rear closure at the first and last elliptic ribs may be of various shapes including convex shaped shell type or plane vertical structural elements. The use of the plane vertical doors and rear closure (wall) may in some cases reduce the cost of the building but the resulting structure will be less aerodynamic and less pleasing aesthetically. When necessary for the purpose of economics, the truncated ellipse structural rib (TESR) is provided with columns very close to its extremities. Also, when necessary for the purpose of economics the TESR is fitted in its central region with a truss which uses it (the TESR) as its top chord.

BRIEF DESCRIPTION OF THE SEVERAL VIEWS OF THE DRAWINGS

Sheets 1, 2 & 3 show FIGS. 1, 2 & 3 which are perspective views of the JPH Building providing an insight into the three dimensional concept of the building.

FIGS. 1, 2 & 3 all show the concrete end walls 18

Figure 4:
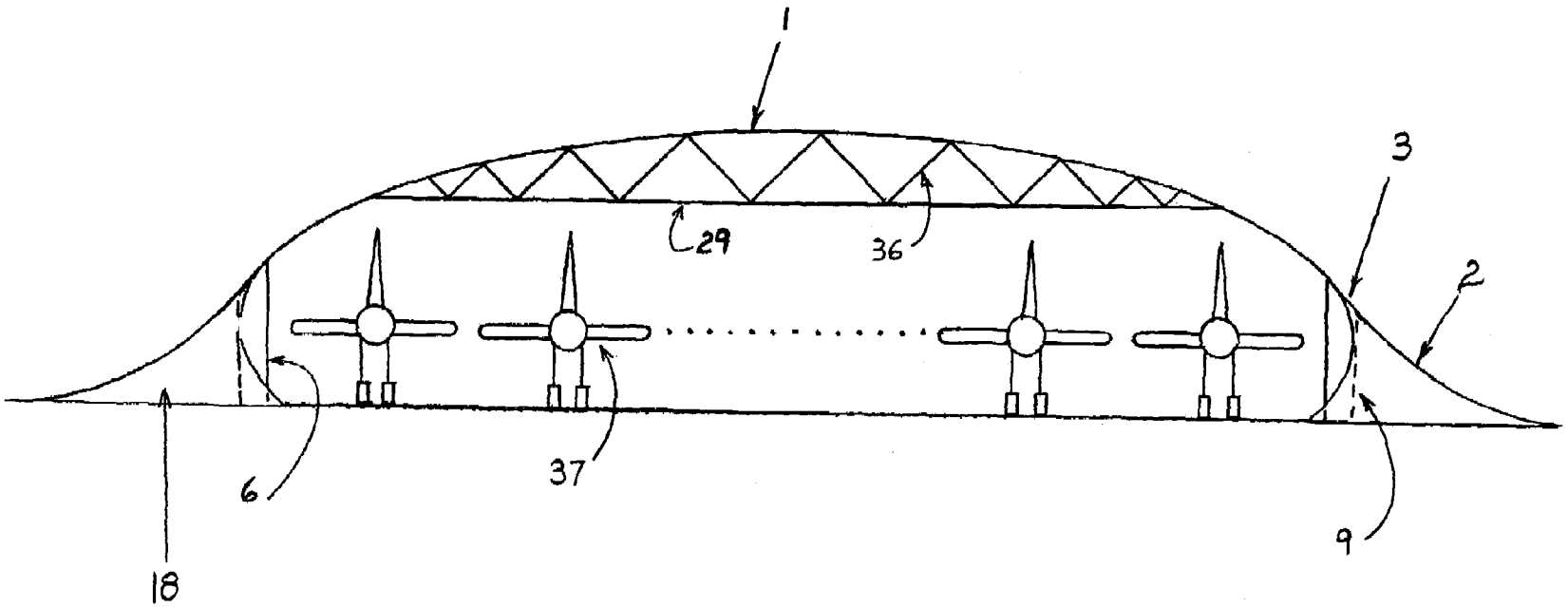

Sheet 4 shows FIG. 4 which is a front elevation of the door opening of the JPH Building with a number of airplanes inside. There is no restriction on the sizes of these airplanes. The full cross sectional aerodynamic profile of the building is displayed, so is the elevation of the truss which uses the T.E.S.R. as its top chord. Columns 6 and concrete end walls 9 are shown. The retaining wall 9 is shown hidden behind the concrete end wall. Member 3 is a concrete slab spanning between the top of the retaining wall and the T.E.S.R.

Figure 5:
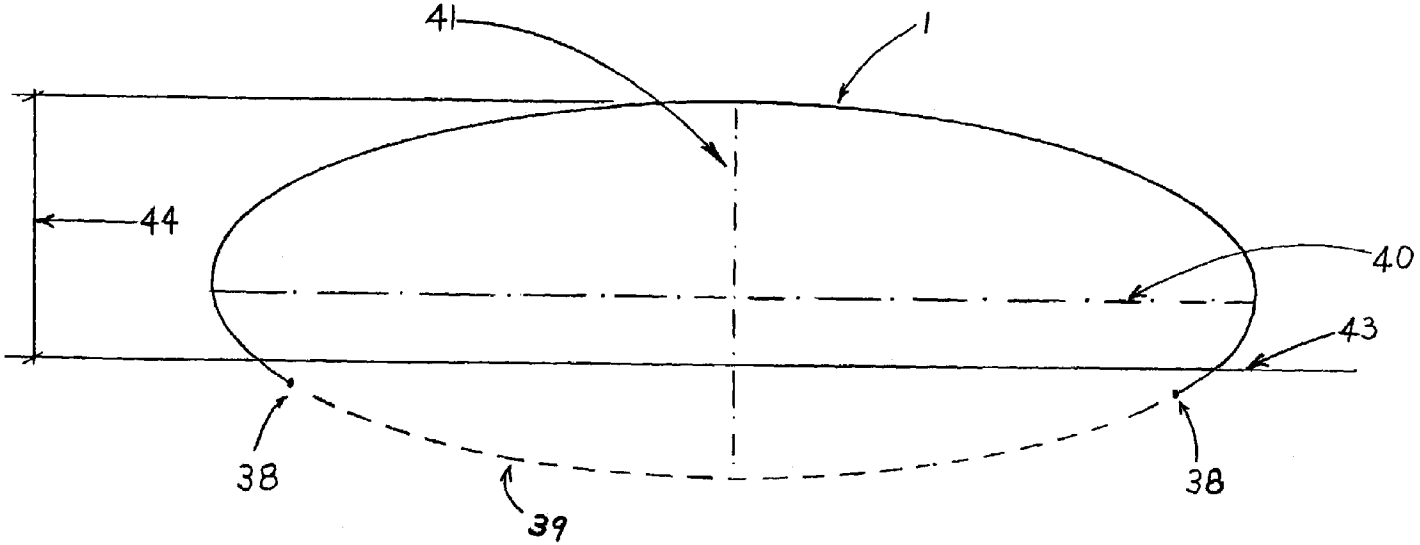
Figure 6:
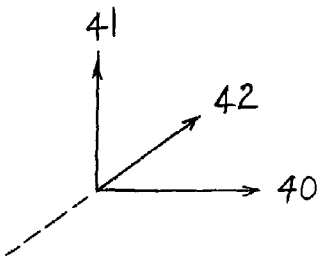

On sheet 5 are FIGS. 5 & 6. FIG. 5 shows the geometry of T.E.S.R. The major (horizontal) and the minor (vertical) axes 40 & 41 are clearly shown, as are the truncation points 38, the portion of the ellipse removed 39, the grade level 43 and the building height 44.

FIG. 6 is the diagram of the rectangular coordinate system showing the horizontal major axis, the vertical minor axis and the third axis 42 representing the depth of the building.

Figure 7:
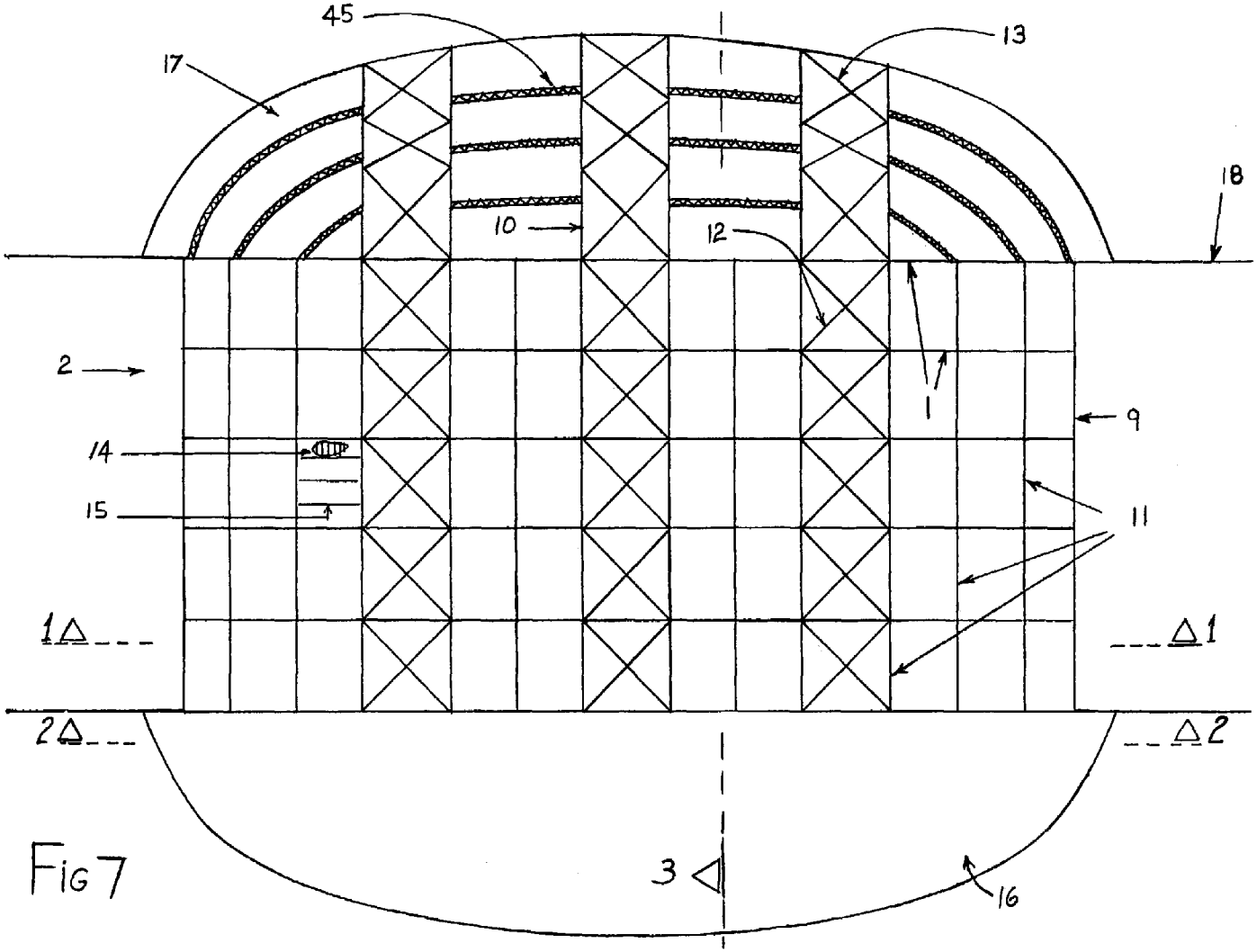
Figure 8:
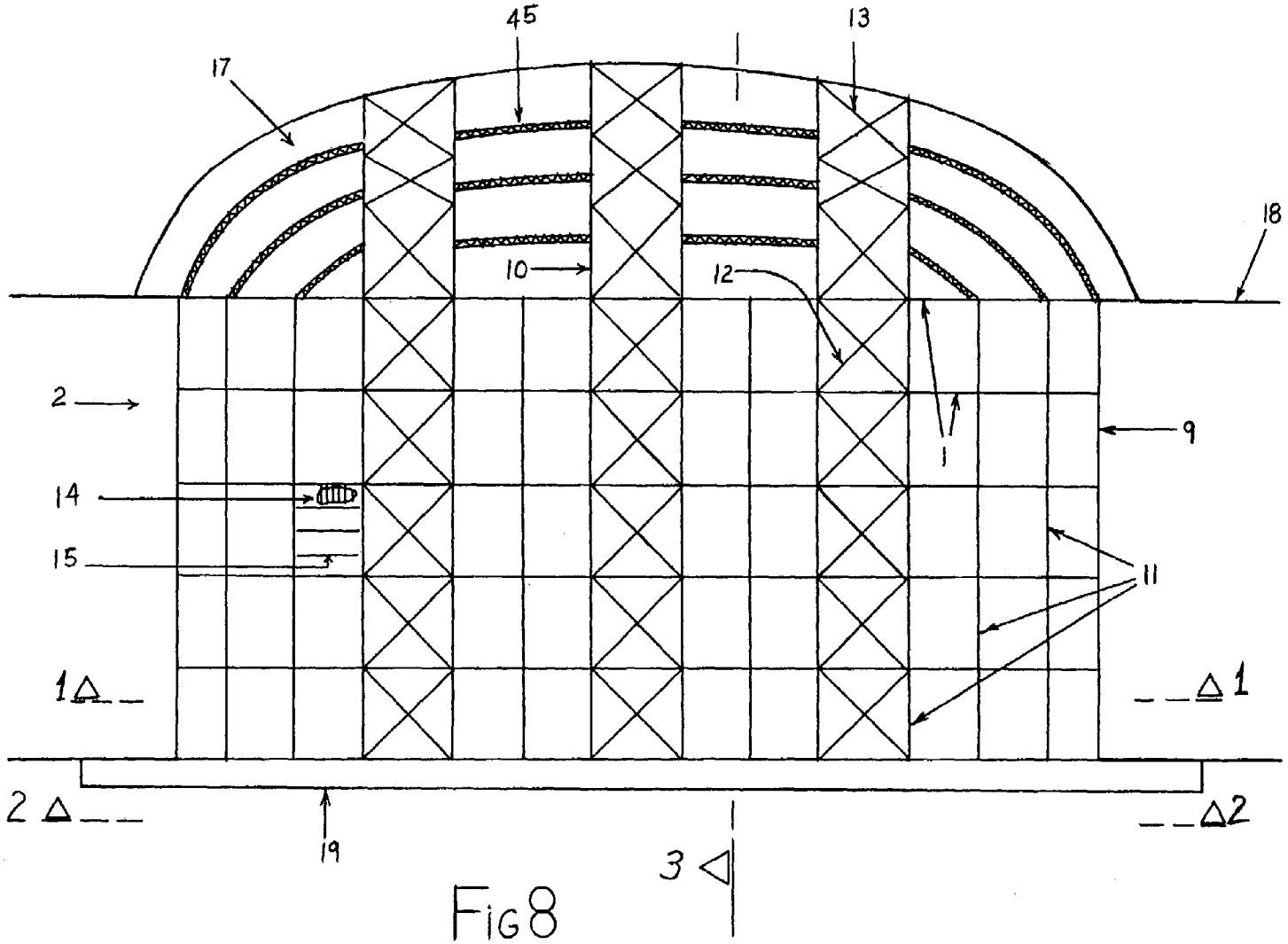
Figure 9:
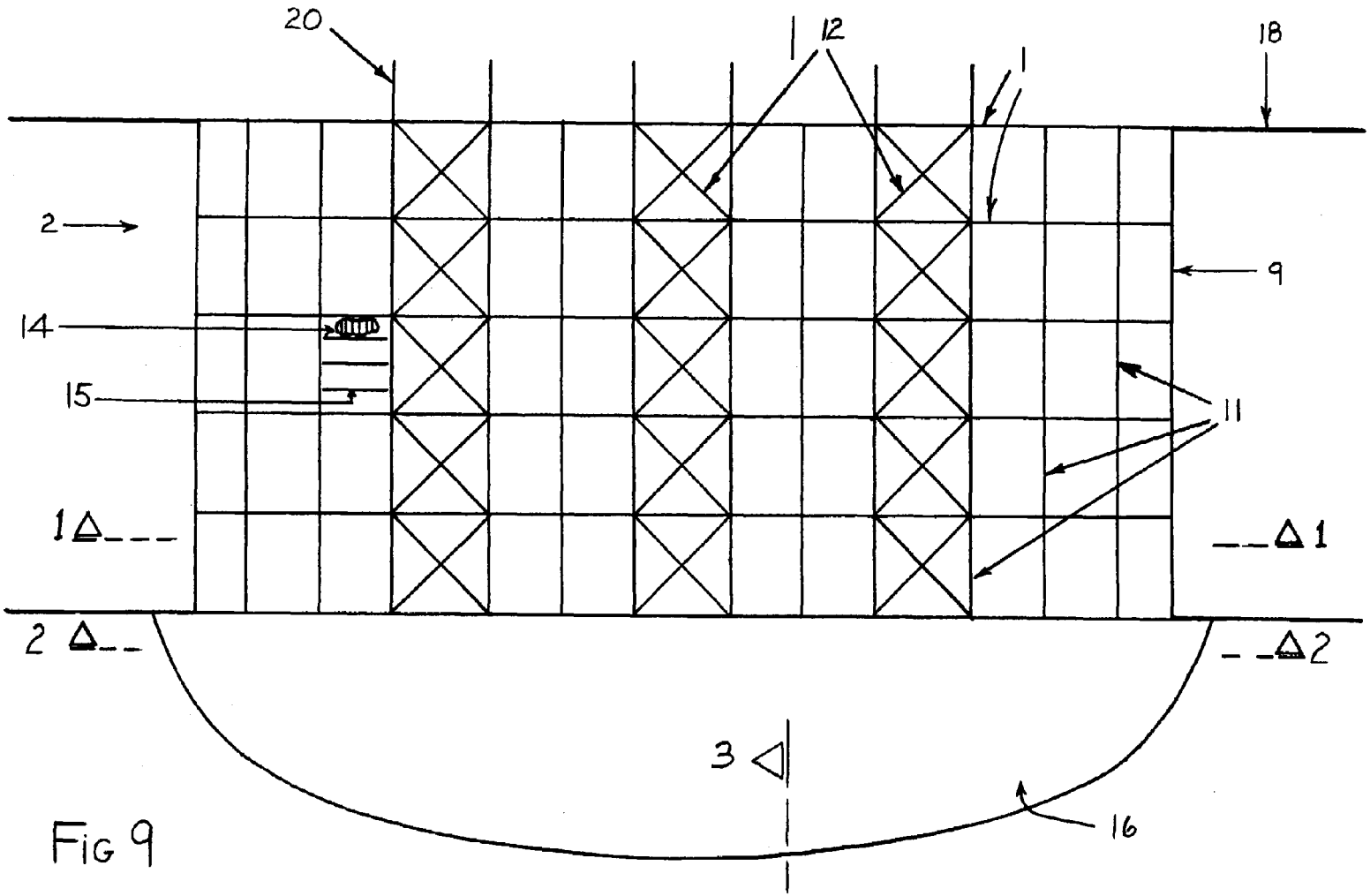
Figure 10:
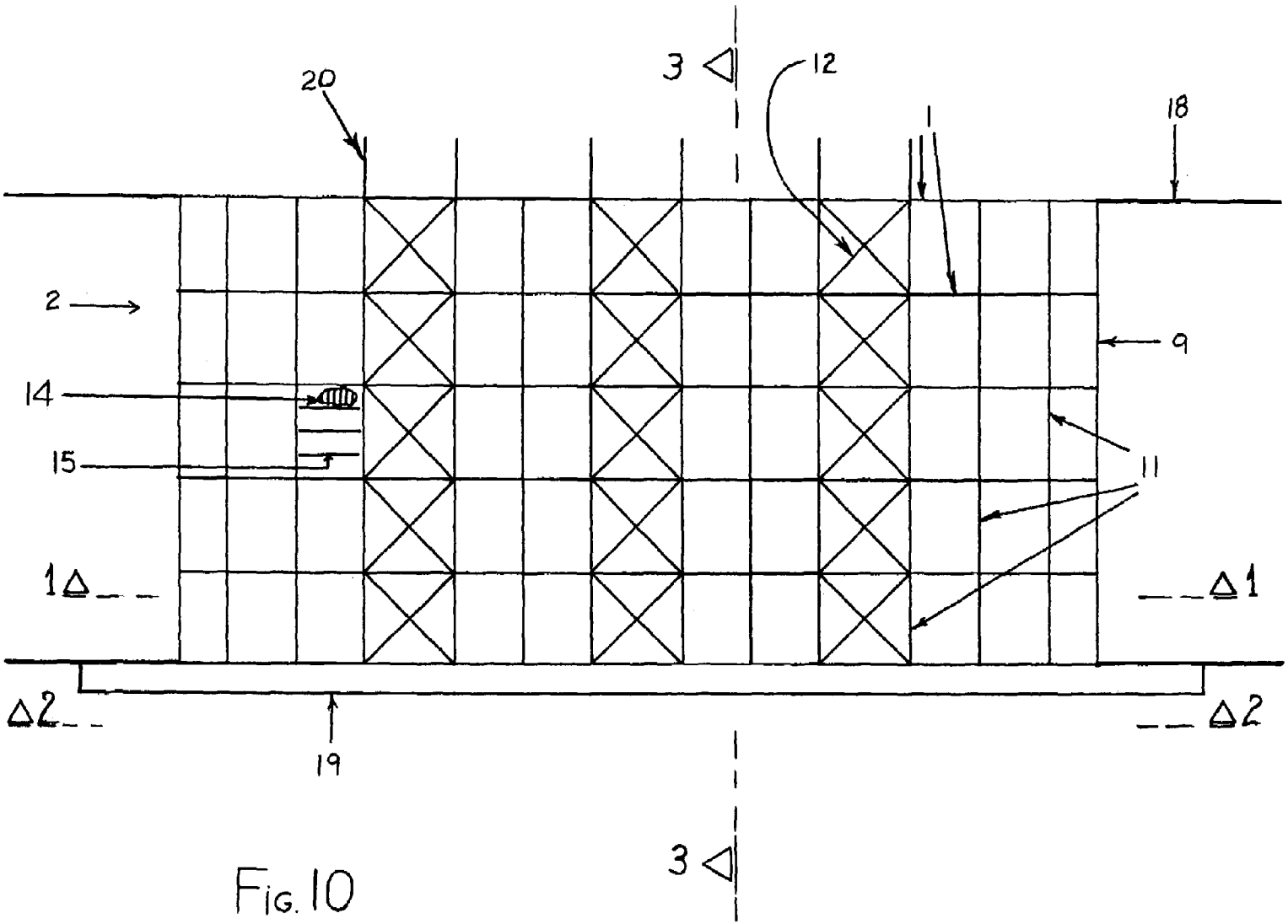
Figure 15:
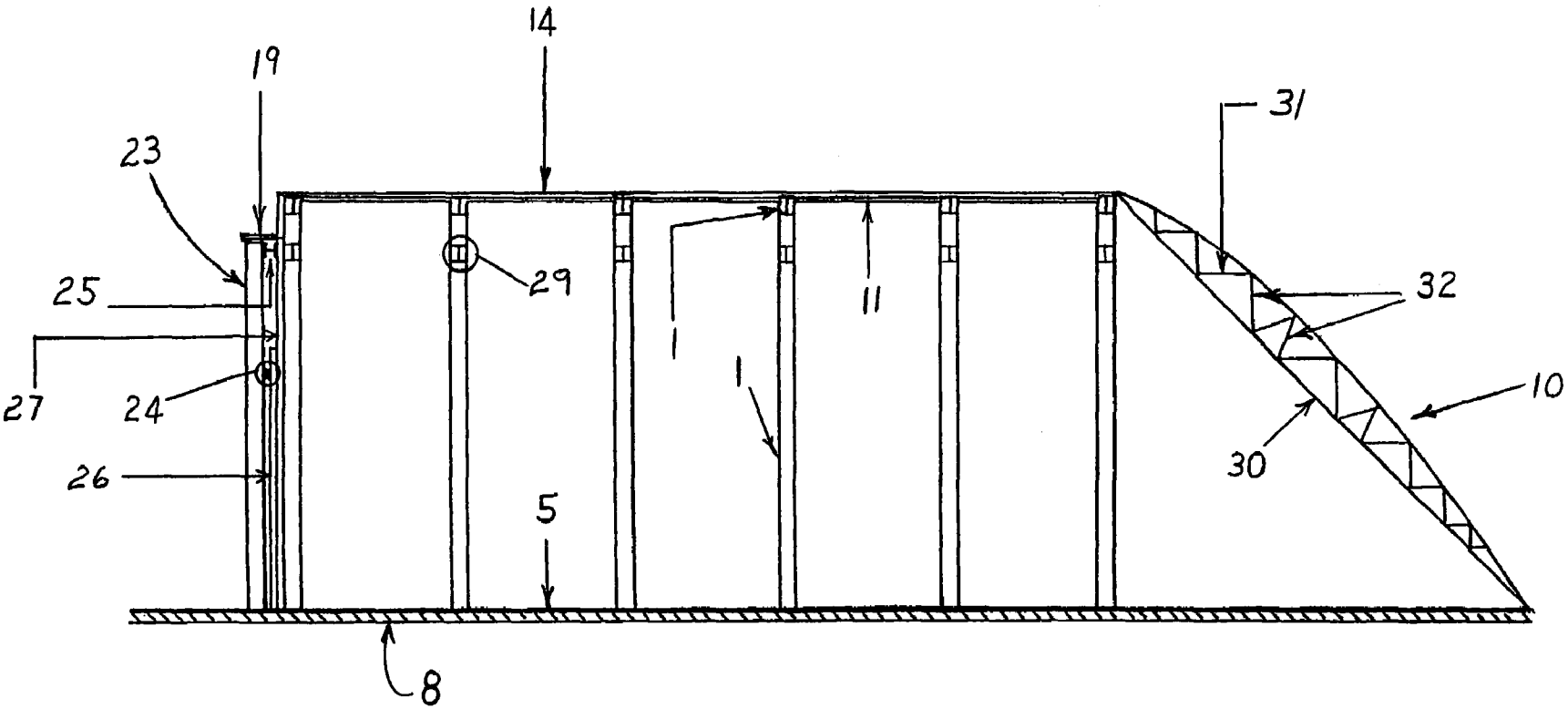

Sheets 6, 7, 8 and 9 show FIGS. 7, 8, 9 and 10 which are plan views showing the basic layout of the structure plus the alternative combinations of the door and rear closure components. The framing system for the main structure (between the first and last ribs) is the same on all four plans, but the door and rear closure vary. Each plan shows the main load carrying members, the elliptical ribs 1 suitably spaced and connected together by diagonal bracing 12 and connecting beams 11. Purlins 15 run perpendicular to the connecting beams, and concrete filled steel decking 14 spans between the purlins. The plans also show at the extremities of the ribs, the concave landscaped areas 2 and the tops of the retaining walls 9, as well as the tops of the end walls 18. FIG. 7 (sheet 6) also shows the convex door 16, convex rear closure 17, horizontal trusses 45 for the convex rear closure, inclined diagonal bracing 13 to ground The sloping trusses 10 help support the horizontal trusses and the bottom chords of these sloping trusses support the inclined diagonal bracing. FIG. 8 (sht. 7) is very similar to FIG. 7. The difference between these two figures is that instead of the convex door of FIG. 7, the building in FIG. 8 uses a vertical plane door. The vertical plane door segments are not shown in FIG. 8 because they are underneath the plane door cover 19 (see section 3B; FIG. 15). FIG. 9 (sht. 8) is also similar to FIG. 7. The difference between FIG. 7 & FIG. 9 is that the building shown in FIG. 9 utilizes plane rear vertical walls instead of the convex rear closure of FIG. 7. In FIG. 9 the diagonal bracings to ground have been replaced by concrete shear walls or steel framed braced walls 20. FIG. 10 is similar to FIG. 9 with the one exception that the building in FIG. 10 does not utilize the convex door but has vertical plane doors. As in FIG. 8 these doors are not seen on the plan since they are hidden by the plane door cover 19 (see section 3D this drawing, & FIG. 17).

Figure 11:
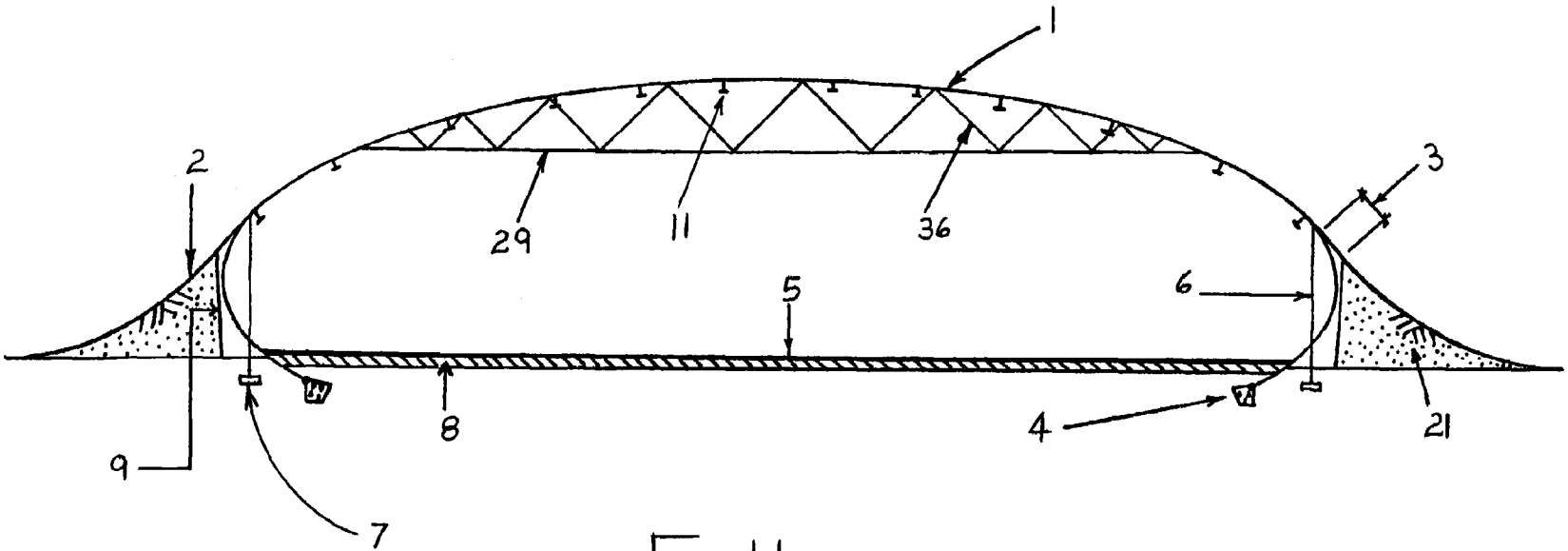

FIG. 11 (sht. 10) shows section 1, which is taken on plan FIGS. 7, 8, 9 and 10. This section shows the profile of the truncated ellipse structural rib 1, the main structural member of the system, along with the profiles of the contiguous concave landscaped areas 2 and concrete slab 3, and how they combine to produce the streamlined aerodynamic form. The section also shows the following:

a) concrete foundations 4 (at the truncation points),
b) the connecting beams 11
c) columns 6
d) retaining walls 9
e) concrete pavement floor 5
f) compacted base 8
g) column footing 7
h) earth fill for landscaped area 21
i) bottom chord of truss with the T.E.S.R as its top chord 29
j) webs of truss using the T.E.S.R. as its top chord 36

The diagonal bracing has been omitted for clarity.

Figure 12:
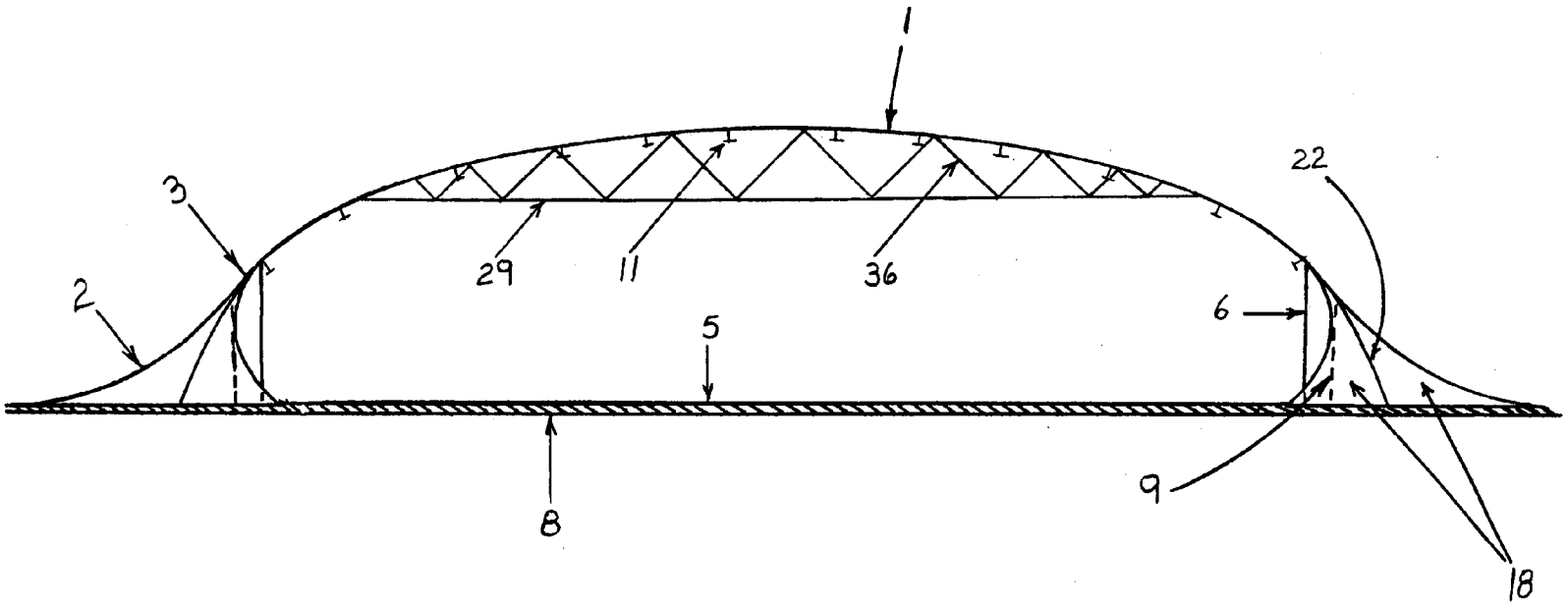

Sheet 11 shows FIG. 12 which represents sectional elevation 2A taken on plan FIGS. 7 & 9 (shts. 6 & 8). It is similar to FIG. 11 and shows the profile of the first structural rib except the portion below grade. Other differences between FIG. 12 and FIG. 11 are that FIG. 12 shows the concrete end wall 18 instead of the earth filled area, and shows at the end wall the closure attachment 22 for the convex door. The retaining wall 9 is shown hidden behind the end wall.

Figure 13:
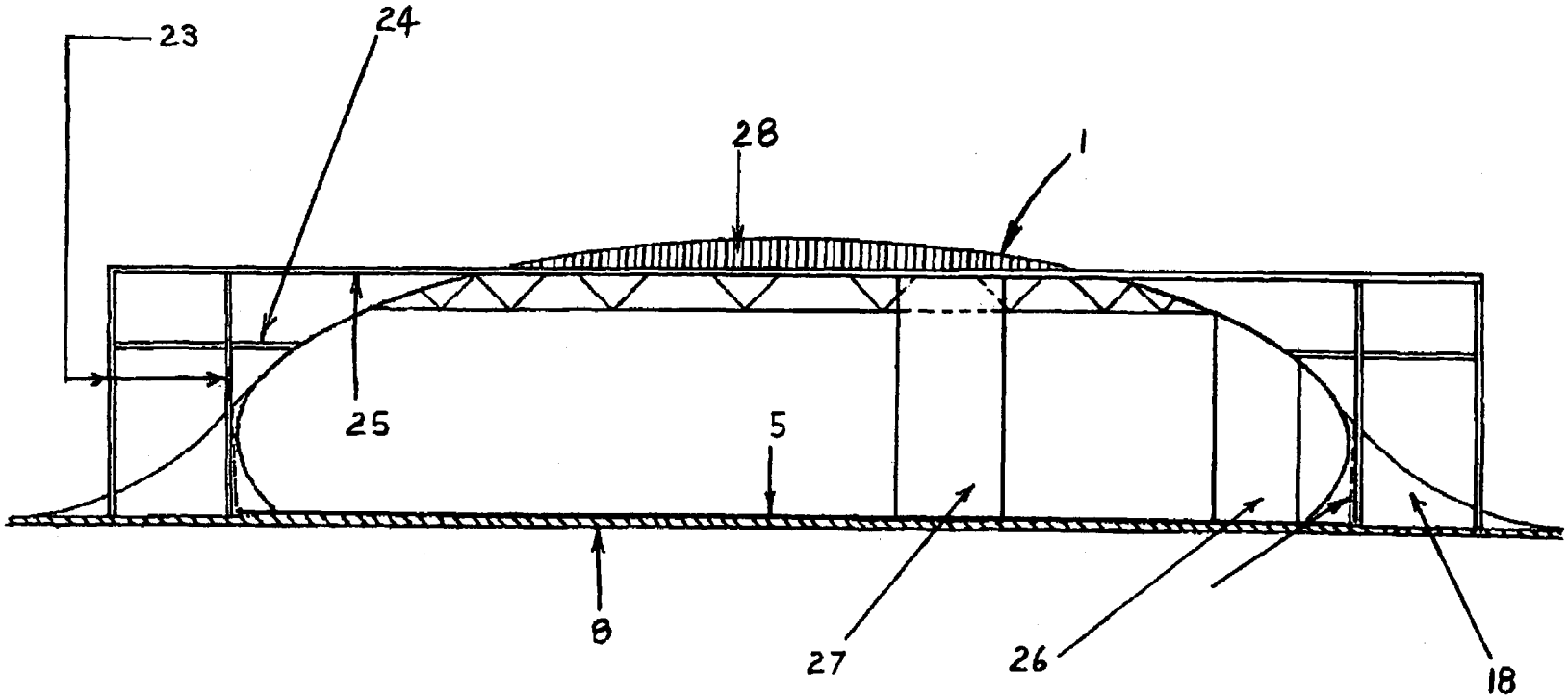

Sheet 12 shows FIG. 13 which represents the sectional elevation 2B taken on FIGS. 8 & 10. It shows the profile of the first structural rib 1 and the elevation of the concrete end wall 18. This is similar to FIG. 12 but instead of the attachment for the convex door it shows the beams 24 & 25 that provide lateral support for the plane door segments 26 & 27 and the frames 23 that provide lateral support for the beams. FIG. 13 also shows the wall 28 above the upper door support beam 25.

Figure 14:
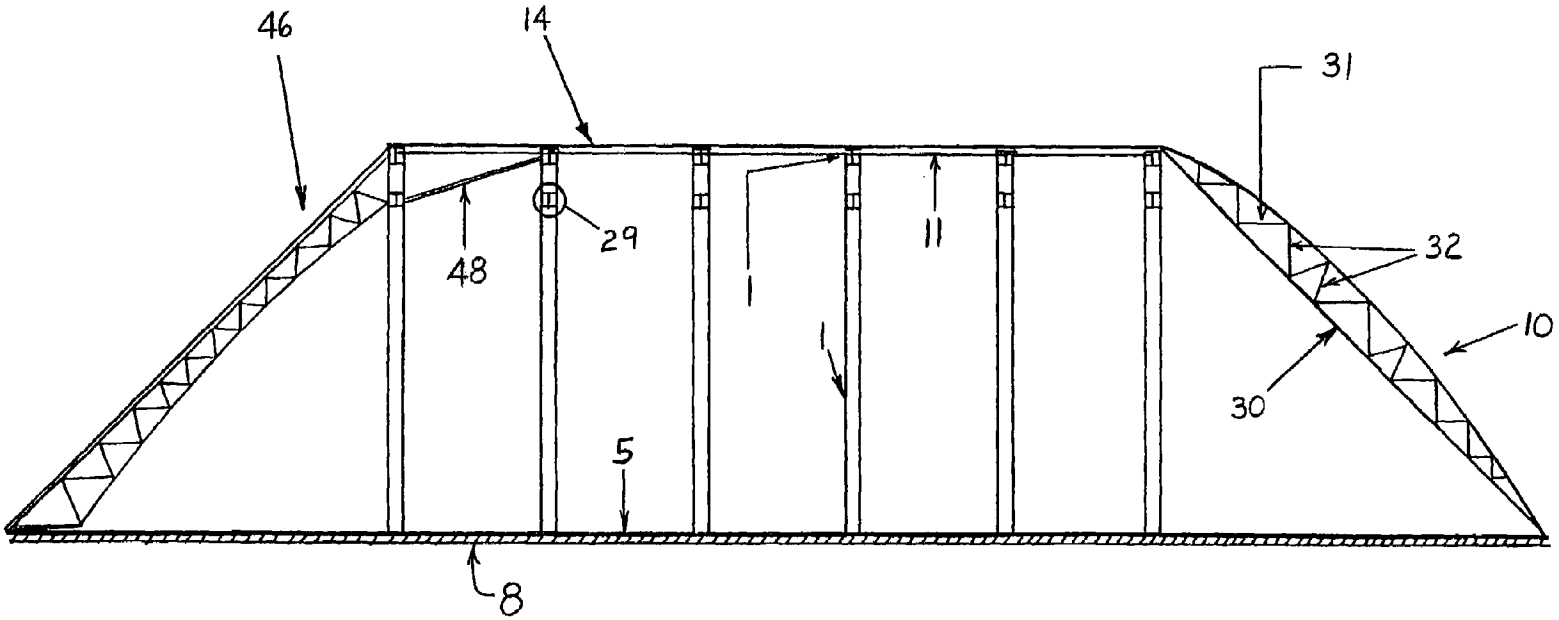

Sheet 13 shows FIG. 14 which represents section 3A, taken on plan FIG. 7 (sht 6). This section is taken perpendicular to the elliptical structural ribs 1, the main structural framing members of the system, and cuts a vertical section through the convex door and convex rear closure. At the rear closure the diagonal bracing from the top of the structure is continued to the ground as inclined diagonal bracing. This inclined diagonal bracing is supported laterally by the members 30 which also serve as the bottom chords for the inclined trusses 10. Also shown are:

a) the horizontal webs 31 of the inclined truss 10.
b) the vertical and inclined webs 32 of the inclined truss 10.
c) concrete pavement floor 5.
d) compacted base 8.
e) elliptical structural ribs 1.
f) bottom chord of truss 29 having the elliptic structural rib as its top chord.
g) connecting beams 11.
h) concrete and metal deck 14 (supported by purlins; purlins not shown for clarity.)
i) moveable truss 46 (with arch shaped bottom chord) the main structural member for the convex door segments. Use of this truss is one of a variety of methods of constructing the convex door.
j) strut 48 for transferring the reaction from the bottom chord of truss 46 into the diagonal bracing system.

Sheet 14 shows FIG. 15. FIG. 15 represents section 3B taken on plan FIG. 8 on sheet 7. It is similar to FIG. 14, but instead of showing truss 46 for the convex door and the strut 48, it shows the section through the plane vertical doors and supporting beams as well as the supporting frames. As is FIG. 14, FIG. 15 is a section cut through the convex rear closure showing the members and components 10,30,31 & 32. The horizontal trusses 45 are not shown for clarity in this view. Other members or components shown in FIG. 15 are:

a) cover over plane door 19.

b) steel frames 23 supporting beams 24 & 25.

c) lower door supporting beam 24.

d) upper door supporting beam 25.

e) non-rectangular plane door segment 26.

f) rectangular door segment 27.

Figure 16:
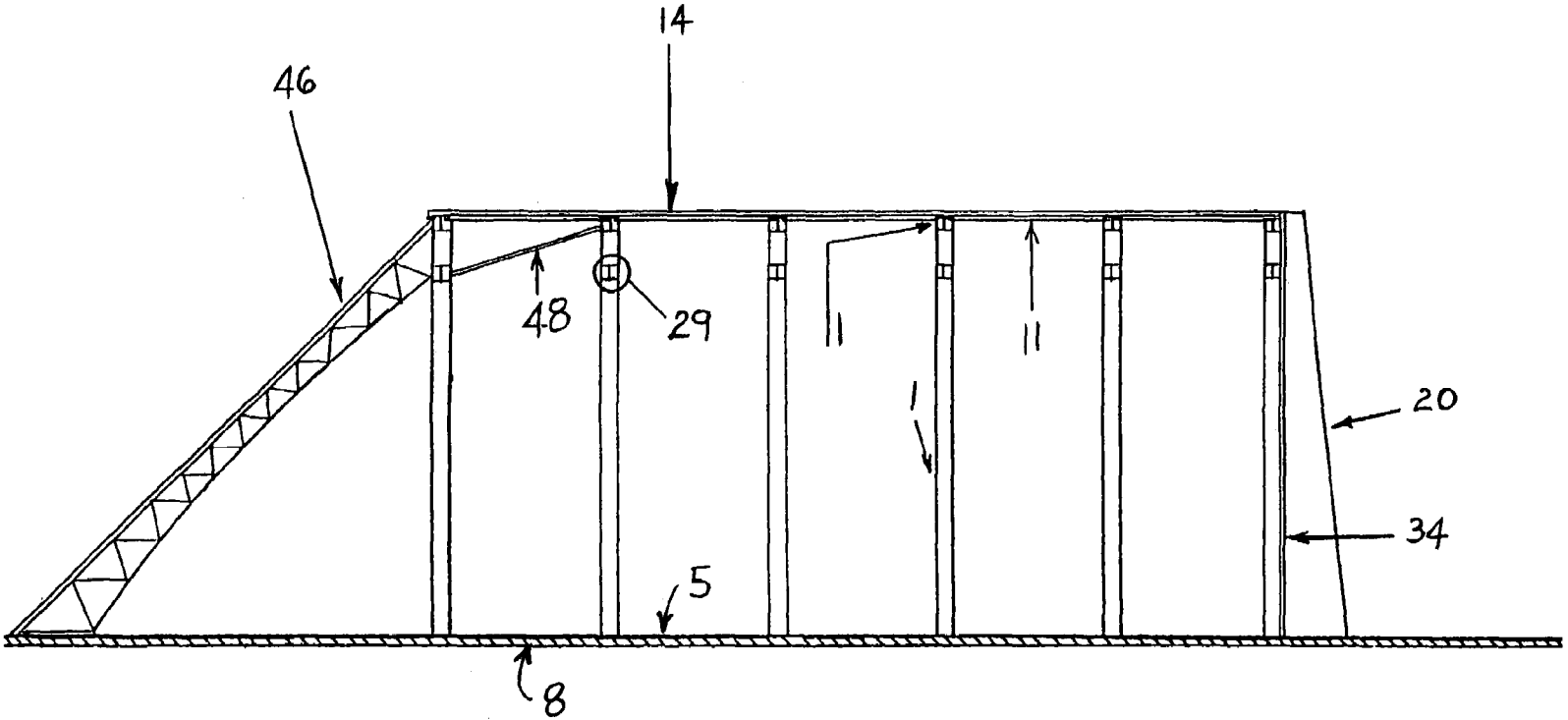

Sheet 15 shows FIG. 16. FIG. 16 represents section 3C taken on FIG. 9 (sht. 8). It is perpendicular to the plane of the elliptical ribs 1 and shows the convex door as in FIG. 14. Instead of the convex rear closure as in FIG. 14, FIG. 16 shows the vertical plane wall at the rear closure 34. Thus the only difference between FIG. 16 & FIG. 14 are the rear closure members. Instead of members 10,30,31 & 32 (as shown in FIG. 14), FIG. 16 shows the following:

a) concrete shear wall or steel framed braced wall 20.

b) rear vertical plane wall 34.

Figure 17:
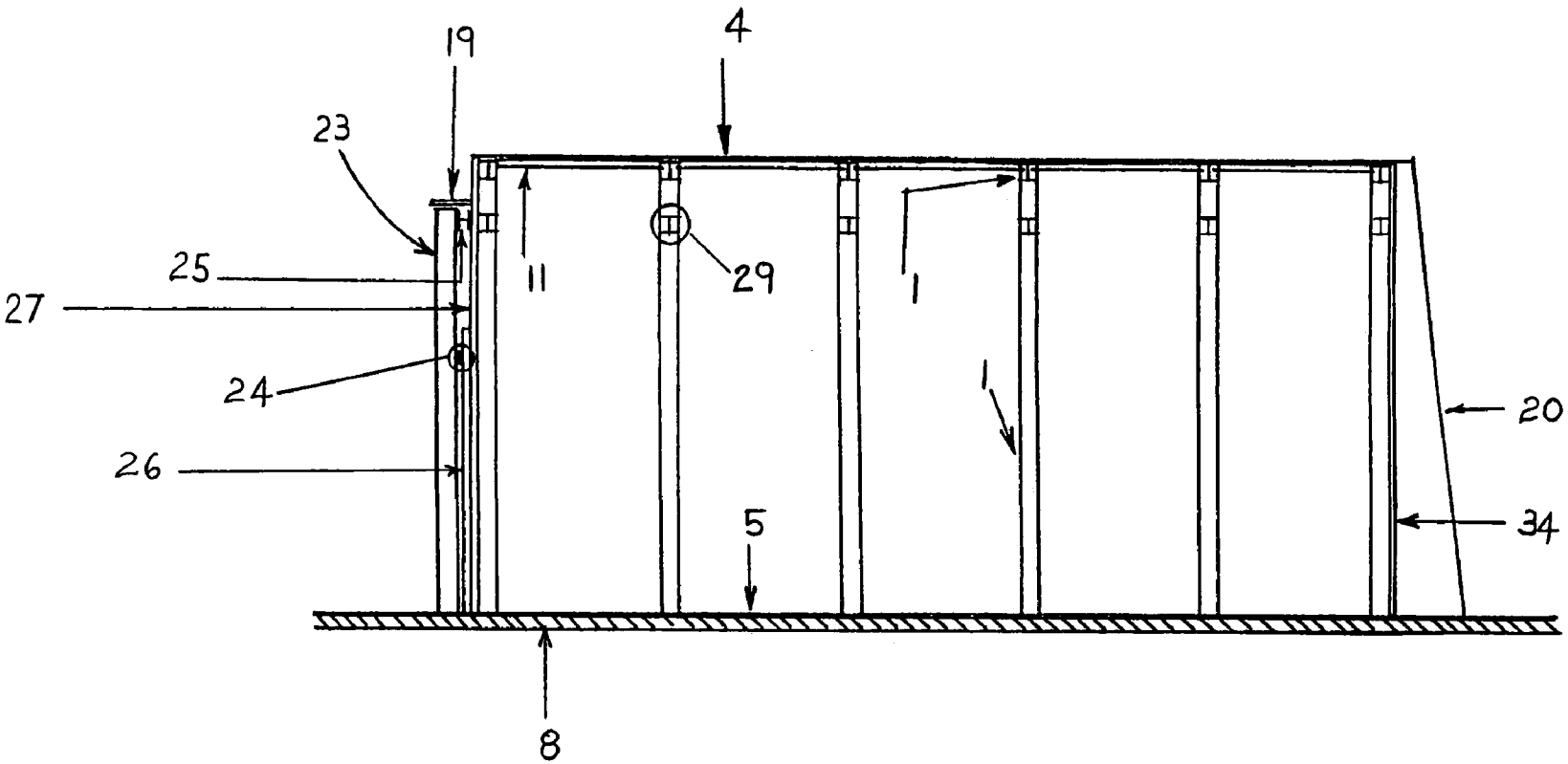

Sheet 16 shows FIG. 17. FIG. 17 represents section 3D taken on plan FIG. 10 (sht. 9). It is perpendicular to the plane of the elliptical ribs and shows the section taken through the plane door at the front and through the vertical rear walls. It actually shows the same as FIG. 15 does in the front and the same as FIG. 16 does in the rear. Also shown in FIG. 17 are:

a) the connecting beams 11 b)elliptical structural ribs 1.

c) concrete on metal deck 14.

d) bottom chord 29 of truss using truncated ellipse structural rib 1 as its top chord.

e) concrete pavement floor 5.

f) compacted base 8.

DETAILED DESCRIPTION OF THE INVENTION

In its optimal form The JPH Building is an aerodynamically shaped spatial structure, primarily of considerable horizontal span (40: FIG. 5),(usually upwards of 300 ft.) suitable horizontal depth (42: FIG. 6) and somewhat varying height (44: FIG. 5). It is formed by assembling a series of truncated ellipse structural ribs 1, parallel to each other, suitably spaced, each in the vertical plane, and in sufficient numbers to provide the required horizontal depth. The elliptical ribs 1 are connected by beams 11 and horizontal diagonal bracing 12. The cross sectional shapes of the elliptical ribs 1 may be wide flange, hollow or solid, rectangular or square, or other suitable structural shape. The lower 25% to 40% (approx.) of the full geometric height (41 in FIG. 5) of each rib is below the ground floor level of the building, with the lowest 20% to 35% (approx.) of the full geometric height of each rib removed, rendering it truncated, open at the bottom. (See 39 in FIG. 5). Concrete foundations 4 (FIG. 11) are provided at the truncation points 38 (FIG. 5). When the truncation points are suitably located (usually where the slope of the rib is less than 45 degrees), unlike most other structural members, under self weight and low or moderate superimposed dead load the elliptical rib 1 adopts a more stable state. At the foundations, this member develops thrusts directed inwards towards the vertical centerline of the rib. These thrusts are taken by the foundations, with the horizontal components being resisted by the passive pressure subsequently developed in the compacted base 8 (FIG. 11) and the subgrade. The thrusts tend to move the truncation points closer together. The rib then behaves like a closed ellipse which is next to the closed circular rib in terms of its high resistance to in plane forces.

Figure 1:
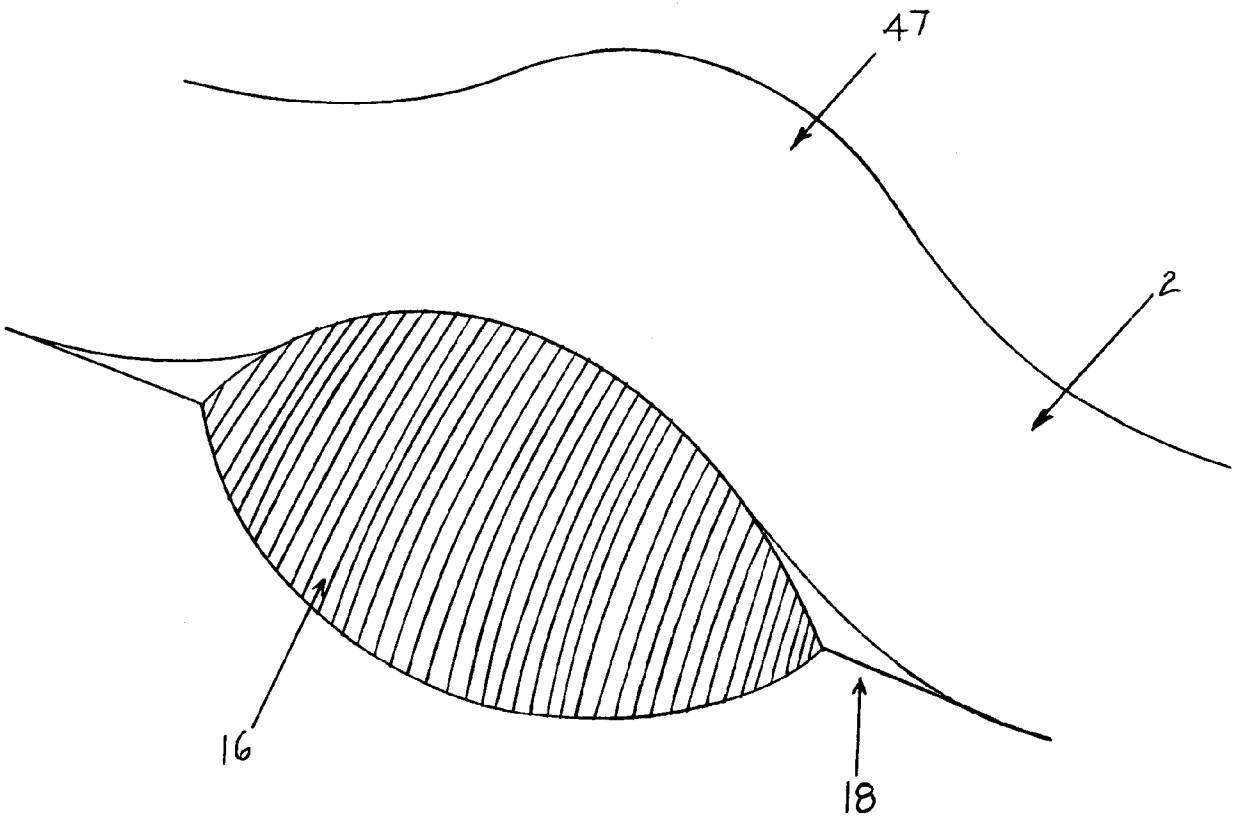
In FIG. 1 the optimum form of the JPH Building is presented with the convex door 16. The externally concave curves 2 and the convex shaped elliptically profiled top of the building combining to form the aerodynamically streamlined surface.
Figure 2:
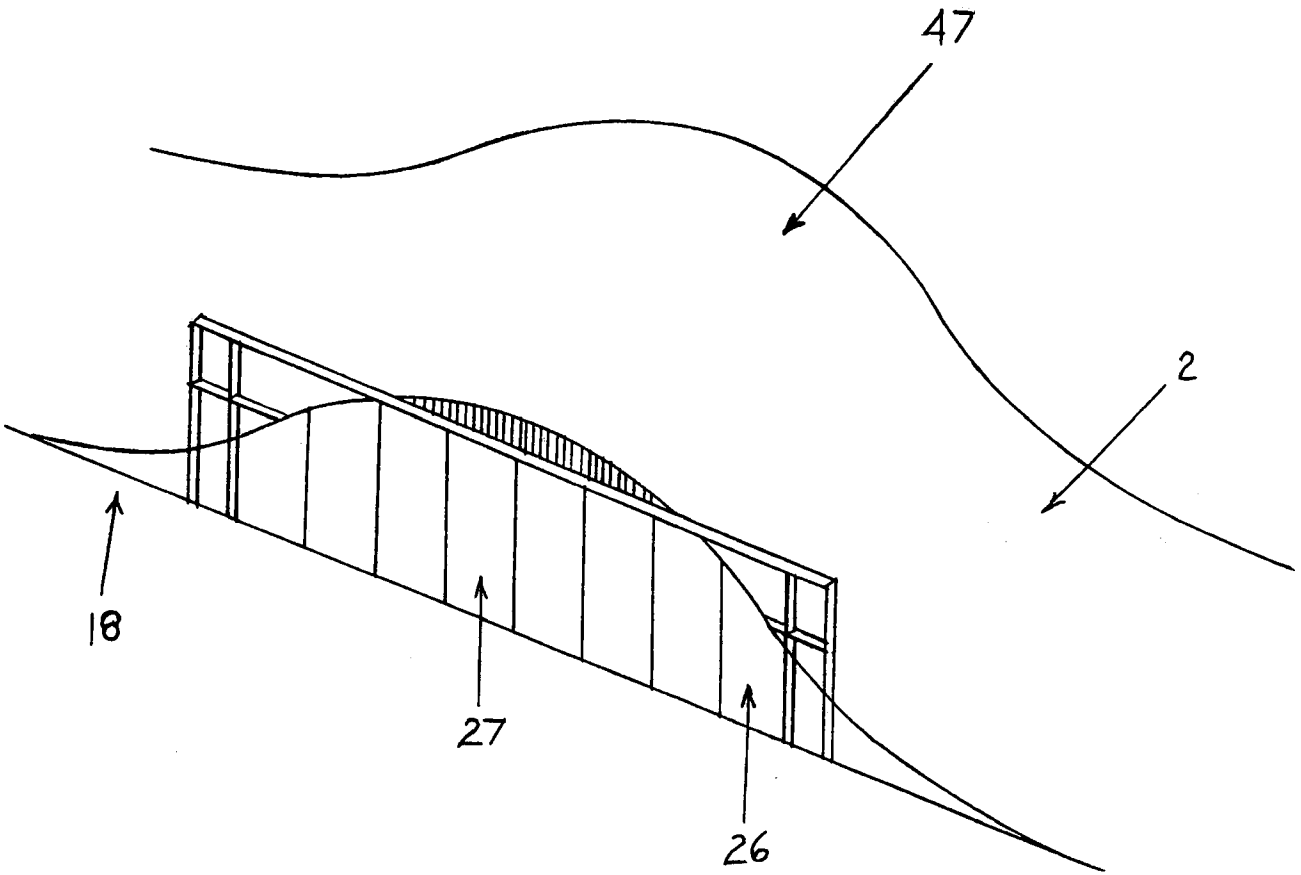
FIG. 2 shows the JPH Building with plane vertical door segments 26 & 27 replacing the convex door in FIG. 1. The aerodynamically streamlined surface from FIG. 1 is maintained.
Figure 3:
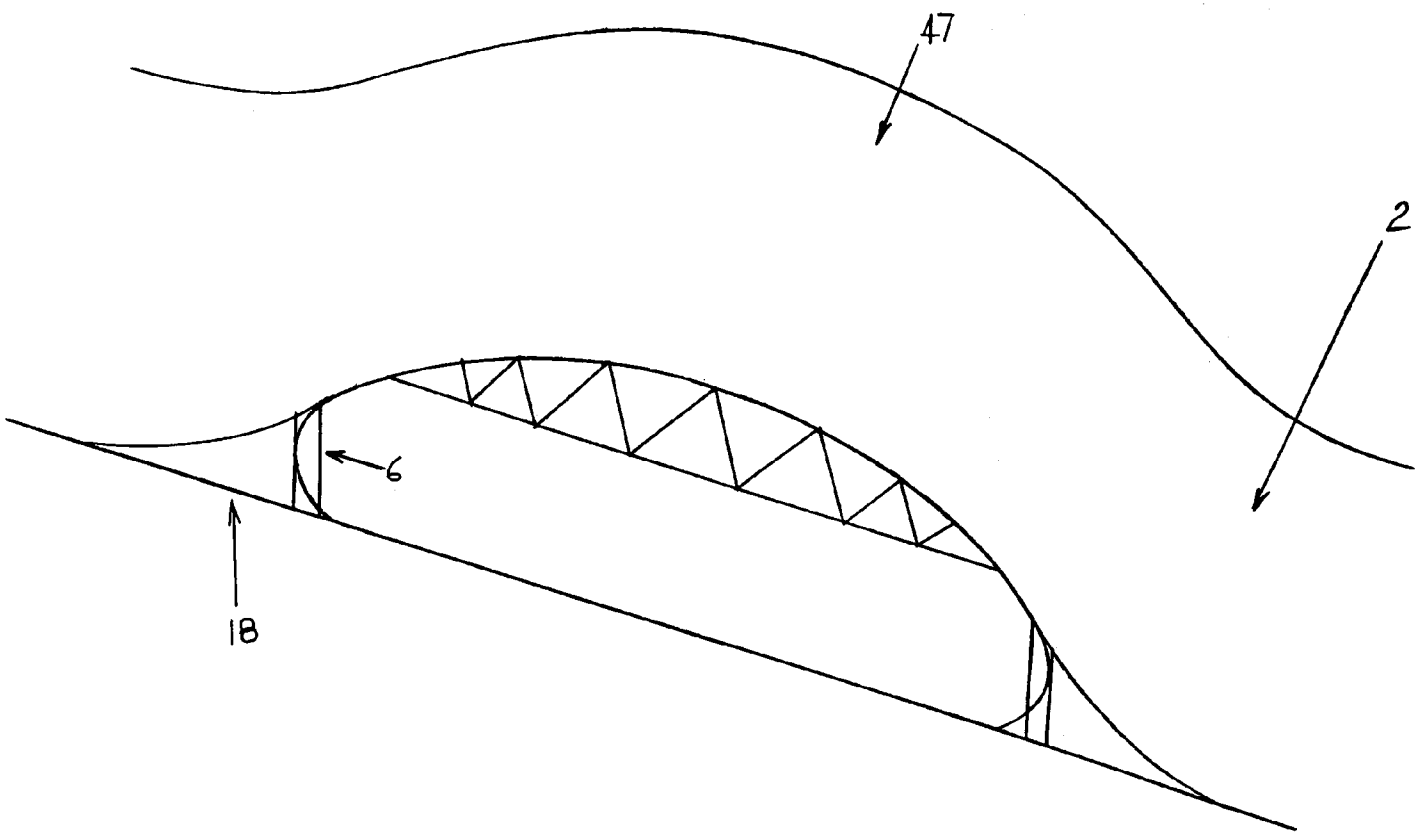
FIG. 3 is the result of removing the convex door from FIG. 1, exposing the full width of the entrance opening. Also exposed are the bottom chord 29 and the webs 36 of the truss that uses the top chord of the truncated ellipse structural rib (T.E.S.R.) as its top chord as well as the columns 6 next to the extremities of the T.E.S.R.

Above the connecting beams 11 and horizontal diagonal bracing 12 are purlins 15. The purlins support the roof, which may consist of rigid insulation boards with sprayed on insulating concrete, or regular weight or lightweight concrete on metal deck 14. The geometry in profile (in the plane of each rib) is completed by providing two streamlined concave surfaces 2 at the extremities of the ribs, each extending from the first to the last rib. The surfaces may be formed using a number of different materials including earth (fill) and concrete. In FIG. 11 grass on earth fill 21 along with a concrete slab 3 are shown forming the concave surfaces 2. The fill is retained by a retaining wall 9. A wall composed of precast concrete panels and geogrids is very suitable for this situation. At the first rib and at the last rib, the fill is retained by reinforced concrete end walls 18 (FIGS. 1, 7, 9 & 12). The concave surface areas 2 and the elliptical roof surface 47 (FIGS. 1, 2 & 3) over the ribs combine to provide the aerodynamically shaped exterior.

For the entrance to the hangar, a number of different door options are possible. Two have been selected and shown in the drawings. The first is a convex door 16 (FIGS. 1, 7 & 9) which is constructed with interlocking segments and in the closed position will be secured to the first elliptic rib and with the closure attachments 22 (FIG. 12), to the concrete end walls 18 (FIGS. 1, 7, 9 & 12). The main structural members of the convex door 16 are movable trusses 46 (FIGS. 14 & 16) with the arched bottom chords. These trusses can move along the length of the first elliptic rib and can then be suitably positioned to facilitate the opening of the doorway. Struts 48 (FIGS. 14 & 16) transfer the upper reaction from trusses 46 to the diagonal bracings 12 (FIGS. 7 to 10). The second type of door is a series of plane vertical door segments 26 & 27 (FIGS. 2, 13, 15 & 17) laterally supported by beams 24 & 25 which are supported by the first rib 1 and a number of braced steel frames 23 (FIG. 13). For the rear closure elements of the building, two similar options have been selected and shown in the drawings. The first option, the convex closure 17 (FIGS. 7, 8, 14 & 15) utilizes horizontal trusses 45 (FIGS. 7 & 8), inclined trusses 10 (FIGS. 14 & 15) and beams; with purlins supporting metal decking, concrete filled or not. The diagonal bracing connecting the ribs are continued as inclined diagonal bracing 13 sloping down from the last rib to the ground. The bottom chord 30 of the inclined truss 10 (FIGS. 14 & 15) also support the inclined diagonal bracing 13 (FIGS. 7, 8, 14 & 15). The horizontal trusses 45 are supported by the top chord s of the inclined trusses 10 (see dwg. shts. 1, 8, 14 & 15).The second option is a plane vertical wall 34 (FIGS. 16 & 17) of reinforced masonry or reinforced concrete . For this option the lateral loading from the diagonal bracing between the ribs is taken by reinforced concrete shear walls 20 (FIGS. 9, 10, 16 & 17) or alternatively by braced steel frames. The convex rear and the plane vertical rear wall may be constructed from metal sheeting (preferably sandwiched) on metal framing The convex door 16 and convex rear closure 17 are shell type components and will attract small wind forces from winds that are perpendicular to the plane of the ribs. These components will resist the wind forces by developing compression internally and by transferring these forces to the horizontal diagonal bracing, to the inclined diagonal bracing, the ground slab and the concrete end walls. The plane vertical doors and rear walls are simpler alternatives and will resist the wind forces in bending. The gates and rear closure members described above are only examples of a variety of shapes that may be used for these components of the structure. The floor is an engineered concrete pavement 5 suitable for aircraft loading when applicable and sits on properly engineered and constructed base 8 and subgrade. (see FIGS. 11 to 17). The shape, cross sectional dimensions, details and material specifications of the structure are determined by the methods of structural analysis and design. At the extremities and the truncation points 38, the cross sectional dimensions of the rib will be greater to resist the greater forces there. The building, when required to be a hangar may be provided with a rear door instead of a rear closure, and with increased horizontal depth (42: FIG. 6) (by increasing the number of ribs) will be able to accommodate one set of aircraft from the front and another from the rear. The capacity of the hangar may be further increased without any increase in structural height, by constructing in bays. This is done by duplicating each original rib 1, erecting other ribs in the same plane end to end. The concave areas between the abutting ribs are then eliminated or greatly reduced.

What is claimed is:

1. A building comprising a plurality of structural ribs, a plurality of beams extending horizontally between adjacent structural ribs in the plurality of structural ribs, a ground floor, and a foundation, wherein each of said structural ribs is formed in an outwardly convex curve as a continuous single member, extending in a flat vertical plane, transmitting bending moments along an entire length of said structural rib, and supporting a portion of the building by extending across a span of the building, each of said structural ribs at least approximately conforms to a geometric profile of an ellipse having a major axis extending above the ground floor and across the span of the building between extremities of the structural rib, with the ellipse being truncated below the ground floor at ends of the structural rib, each of said structural ribs curves back under itself, from extremities of the structural rib to extend below the ground floor to the ends of the structural rib engaged by the foundation of the building, said structural ribs extend parallel to one another, being spaced apart along a length of said building, and each of said structural ribs extends upward to a height substantially less than a width of said span of the building.

2. The building of claim 1, wherein each structural rib within said plurality of structural ribs includes end portions extending downward and inward at reducing or constant slopes.

3. The building of claim 1, additionally comprising front and rear openings equal in width to the span of said building.

4. The building of claim 1, wherein each structural rib in the plurality of structural ribs includes externally convex outer portions extending inward from the extremities of the structural rib and an externally convex inner portion extending between the outer portions, the building additionally comprises a truss extending under said externally convex inner portion of each of said structural ribs and a column extending within each of said externally convex outer portions of each of said structural ribs.

5. The building of claim 4, additionally comprising bracing members extending diagonally between intersections of said beams and said structural ribs.

6. The building of claim 5, additionally comprising purlins extending between said beams; and a roof supported by said purlins and said structural ribs between edges of said roof, wherein said edges of said roof are located at a level above the major axes of said structural ribs.

7. The building of claim 6, additionally comprising a concave outer surface extending outward and downward from each of said edges of said roof.

8. The building of claim 7, additionally comprising earth fill extending under each said concave outer surface.

9. The building of claim 8, additionally comprising a retaining wall close to the of the structural ribs.

10. The building of claim 8, additionally comprising a flat, vertical door assembly closing off an entrance to said building and disposed adjacent an outermost structural rib within said plurality of structural ribs.

11. The building of claim 8, additionally comprising an outwardly convex door structure at an end of said building outwardly adjacent an outermost structural rib within said plurality of structural ribs, wherein said outwardly convex door structure includes a plurality of horizontal door segments, stacked vertically, offset horizontally, and secured together, each having an upper door edge and a lower door edge, said upper door edge of an uppermost door segment extends along an upper portion of said outermost structural rib, the upper door edges of the remaining door segments abut against lower edges of door segments above, and each upper door edge and each lower door edge extends along an outwardly convex line, with said door segments in a closed position, said door segments may be removed and stored on the roof of said building when the opening to the building at the outermost structural rib is in the open position, said door segments in said closed position extend across an opening to the building within said outermost structural rib, and said door segments in said open position outwardly expose said opening within said outermost structural rib.

12. The building of claim 11, additionally comprising a first truss extending downward from a central portion of said outermost structural rib;

a plurality of struts extending inward between said outermost structural rib and a structural rib inwardly adjacent said outer outermost structural rib;

a second truss extending downward from a door segment in said plurality of door segments, wherein said second truss engages said first truss with said door segment in said closed position.

13. The building of claim 10, additionally comprising a flat vertical closure wall extending at a rear end of said building outwardly adjacent an outermost structural rib within said plurality of structural ribs.

14. The building of claim 1 or 10, additionally comprising an outwardly convex closure extending at a rear end of said building outwardly adjacent an outermost structural rib within said plurality of structural ribs, wherein said outwardly convex closure extends downward and outward between an upper portion of said outermost structural rib and an outwardly curved lower edge of said outwardly convex closure.

15. The building of claim 14 wherein said outwardly convex closure extending at the rear of said building comprises:

a plurality of inclined trusses extending downward and outward from said upper portion of said outermost structural rib, wherein each of said inclined trusses extends within a vertical plane;

a plurality of horizontally curved trusses extending between adjacent inclined trusses and between the outermost structural rib and first and last inclined trusses within said plurality of inclined trusses a plurality of purlins extending between said trusses; and metal decking supported by said plurality of purlins.

16. The building of claim 15, additionally comprising a plurality of inclined diagonal braces extending from a top of said outermost structural rib to ground between adjacent inclined trusses within said plurality of inclined trusses.

17. The building of claim 9, additionally comprising an outwardly convex door structure at an end of said building, outwardly adjacent to an outermost structural rib within said plurality of structural ribs, wherein said outwardly convex door structure includes a plurality of vertical door segments, each having a left edge and a right edge, each having connections to the upper portion of the outermost structural rib and to the ground, said connections can be readily engaged and disengaged, each of said vertical door segments aligns with, and is secured to, each adjacent vertical door segment within a plurality of vertical door segments with the door segments in a closed position and connections engaged, and said vertical door segments may be removed and stored on the roof of the building with said connections disengaged.

18. The building of claim 9, additionally comprising a flat, vertical door assembly closing off an entrance to said building and disposed adjacent to an outermost structural rib within said plurality of structural ribs, wherein said door structure includes:

a plurality of horizontal beams fastened to said outer outermost structural rib; and a plurality of door panels mounted to slide on said horizontal beams between a closed position and an open position, wherein said door panels extend across an opening within said outermost structural rib in said closed position, and wherein said door panels outwardly expose said opening within said structural rib in said open position.

19. The building of claim 9, additionally comprising an outwardly convex door structure at an end of said building outwardly adjacent an outermost structural rib within said plurality of structural ribs, wherein said outwardly convex door structure includes a plurality of horizontal door segments, stacked vertically, offset horizontally and secured together, each having an upper door edge and a lower door edge, said upper door edge of an uppermost door segments extends along an upper portion of said outer outermost structural rib, said upper door edges of remaining door segments abut against lower edges of door segments, and each upper door edge and each lower door edge extend along an outwardly convex line with said door segments in a closed position, said door segments may be removed and stored on the roof of said building when the opening to the building at the outer outermost structural rib is in the open position, said door segments in the closed position extend across an opening to the building within said outermost structural rib, and said door segments in said open position outwardly expose said opening with said outermost structural rib.

20. The building of claim 8, additionally comprising an outwardly convex door structure at an end of said building, outwardly adjacent to an outermost structural rib within said plurality of structural ribs, wherein said outwardly convex door structure includes a plurality of vertical door segments, each having a left edge and a right edge, each having connections to the upper portion of the outermost structural rib and to the ground, said connections can be readily engaged and disengaged, each of said vertical door segments aligns with, and is secured to, each adjacent vertical door segment within a plurality of vertical door segments with the door segments in a closed position and connections engaged, and said vertical door segments may be removed and stored on the roof of the building with said connections disengaged.

21. The building of claim 20, additionally comprising:

a first truss extending downward from a central portion of said outermost structural rib;

a plurality of struts extending inward between said outermost structural rib and a structural rib inwardly adjacent said outermost structural rib; and a second truss extending downward from a door segment in said plurality of door segments, wherein said second truss engages said first truss with said door segment in said closed position.

22. The building of claim 8, wherein each of said structural ribs is composed of a monolithic structural material.

23. The building of claim 8, wherein each of said structural ribs is composed of metal sections fastened together.

24. The building of claim 7, additionally comprising an elevated deck in a shape of said concave outer surface, supported by columns or walls.

25. The building of claim 1, wherein each of said structural ribs is composed of a monolithic structural material.

26. The building of claim 1, wherein each of said structural ribs is composed of metal sections fastened together.

27. The building of claim 1, wherein each of said structural ribs is formed to extend along a smooth, continuous curve.

28. The building of claim 1, wherein each of said structural ribs is formed to extend along a series of end-connected straight line segments.

* * * * *